United States Patent [19]

Ookubo et al.

[11] 4,113,439

[45] Sep. 12, 1978

[54] COOKING APPARATUS EMPLOYING A PURGING DEVICE

[75] Inventors: Toshio Ookubo, Nara; Atsushi Nishino, Neyagawa; Tadashi Suzuki, Katano, all of Japan

[73] Assignee: Matsushita Electric Industrial Co., Ltd., Osaka, Japan

[21] Appl. No.: 721,545

[22] Filed: Sep. 8, 1976

[30] Foreign Application Priority Data

| | | | |
|---|---|---|---|
| Sep. 11, 1975 | [JP] | Japan | 50-110788 |
| Dec. 26, 1975 | [JP] | Japan | 50-159379 |
| Dec. 26, 1975 | [JP] | Japan | 50-159382 |

[51] Int. Cl.[2] ..... F23J 5/10

[52] U.S. Cl. ..... 422/177; 126/200; 126/190; 126/193; 126/299 R; 432/65; 219/391; 99/332; 99/416

[58] Field of Search ..... 23/288 F, 288 FB; 126/200, 190, 193, 299 R; 432/65; 219/391; 428/309

[56] References Cited

U.S. PATENT DOCUMENTS

| | | | |
|---|---|---|---|
| 2,862,095 | 11/1958 | Scofield | 126/299 R X |
| 3,428,434 | 2/1969 | Huiko | 23/288 F |
| 3,681,557 | 8/1972 | Suzuki et al. | 126/190 X |
| 3,718,498 | 2/1973 | Denny et al. | 428/309 |
| 3,962,561 | 6/1976 | Maitenaz | 23/288 F |

*Primary Examiner*—James H. Tayman, Jr.

*Attorney, Agent, or Firm*—Wenderoth, Lind & Ponack

[57] ABSTRACT

A cooking apparatus employing a purging device.

In the apparatus, an exhaust gas which is produced from food being cooked in a cooking chamber is passed through the purging device and is exhausted to the exterior of the chamber at a temperature of 130° C or at a discharge rate of higher than 0.5 m/sec thereby being purged sufficiently.

2 Claims, 24 Drawing Figures

COOKING APPARATUS EMPLOYING A PURGING DEVICE

A cooking apparatus having the capability of purging oil fumes, etc., generated from foods being cooked in the apparatus.

Conventional cooking apparatus has had the problem that it discharges the oil fumes, etc., generated from the foods being cooked, directly into the room containing the apparatus, causing contamination inside the room or doing harm to health. During cooking at high temperatures, especially when baking highly oily or fatty fowl, fish, etc., in an oven not only are heavy oil fumes and cooking odors produced, but the evaporated oils and fats stick to and burn on the glass window of the hinged door or on the inside walls of the cooking chamber of the oven, and consequently, the fouled chamber walls retain the odor producing an adverse effect on subsequent cooking.

In an attempt to solve this problem, various modifications have been made. Thus, for the removal of the oils and fats adhering to the inside walls of the cooking chamber, a self-cleaning system has been developed in which an oxide catalyzer is carried on the enameled iron plates forming the chamber, and the adhering oil drops are removed by and oxidation reaction. By this means, the soiling of the inside of the cooking chamber has been reduced, but since the adhesion of oils and fats on the glass window of the hinged door can not be eliminated, the problem that the frequency with which it is necessary to clean the cooking apparatus cannot be reduced remains unsolved. Another method in which the material sticking on the chamber walls is burnt off by heating the cooking chamber walls to a high temperature such as 400° - 510° C has been tried as an alternative to the self-cleaning system. Generally, if the cooking temperature goes above 200° C when cooking fowl, fish, etc., however, the amount of cooking fumes generated is abruptly increased. Accordingly, such a system will suffer from the large amount of fumes generated. It is for this reason that a cooking apparatus has been proposed in which a fume purging function has been added by providing a self-cleaning device with a platinum catalyzer. (U.S. Pat. Nos. 3,536,457 and 3,428,435.)

With such an apparatus, the amount of fumes which must be discharged during the cooking is reduced appreciably, as compared with conventional apparatuses, but the apparatus is not entirely satisfactory.

The object of this invention is, therefore, to get rid of the above described disadvantage, that is, to provide an excellent cooking apparatus which not only permits practically no oil fumes and odor produced to get out of the cooking apparatus, but allows no oils and fats to stick on the inside walls of the chamber.

Figure 1:
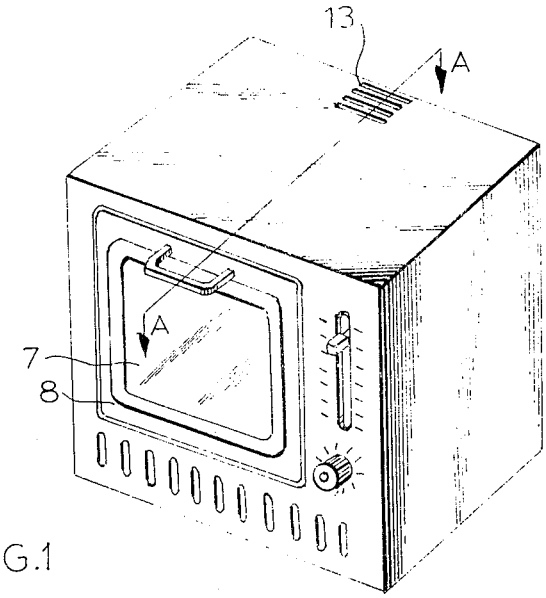
FIG. 1 is a perspective view of a cooking apparatus embodying the present invention.
Figure 2:
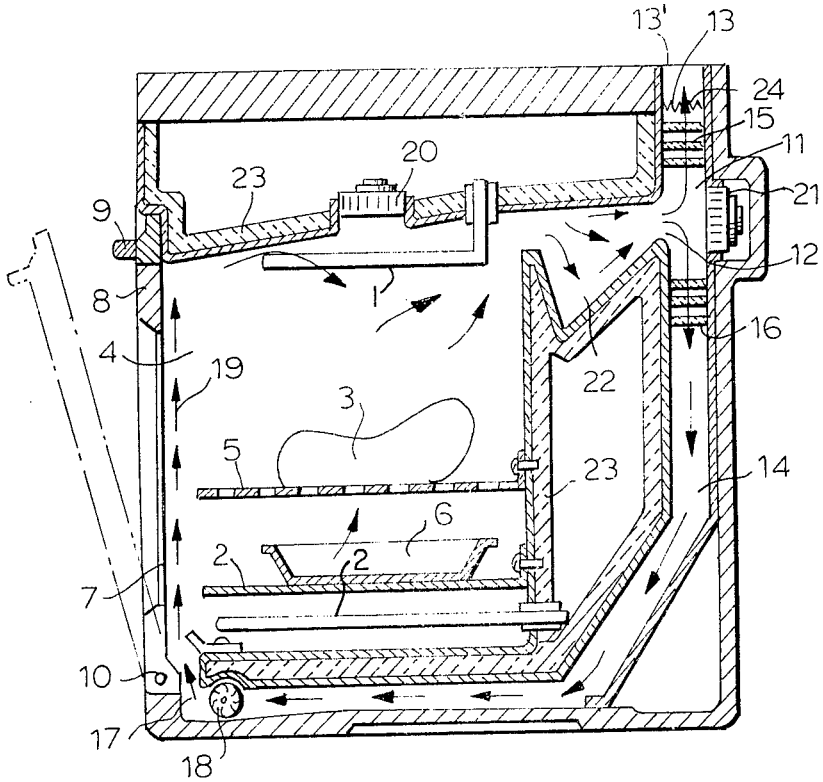
FIG. 2 is a sectional view of the cooking apparatus taken along the line A—A' in FIG. 1.

In the following, a cooking apparatus embodying this invention is described in detail;

Referring to FIGS. 1 and 2, numerals 1 and 2 denote an infrared ray heater and a sheath heater provided as a heat sources for heating foods 3 to be cooked. These heaters may be replaced with a conventional gas burner. In a cooking chamber 4, apertured shelves 5 on which the foods to be cooked are carried and a receiving plate 6 which catches the fluids dripping from the foods being cooked are provided, and at the front, a hinged door 8 having a transparent glass window 7 which permits the observation of the foods being cooked is provided. The hinged door 8 turns on a pivot 10 and opens by pulling a knob 9. Numeral 11 designates a purging device for discharging the oil fumes generated from the foods being cooked. This device is composed of an exhaust passage 13 through which the exhaust introduced from an exhaust passage inlet 12 is discharged out of the cooking apparatus, a guiding passage 14 through which part of the exhaust from the inlet 12 is again led into the chamber and catalyzers 15 and 16 for purging the oil fumes and cooking odors disposed in the guiding passage 14 and the exhaust passage 13.

The guiding passage 14 is communicated to an outlet 17 from the cooking chamber in the shape of an oblong opening extending in the width direction of the chamber. The exhaust led to the guiding passage 14 is fed into the interior of the chamber 4 by a first circulation fan 18 located in the guiding passage 14, thereby forming a uniform curtain of air 19 flowing over the inside surface of the hinged door 8. The air curtain 19 is for reducing the adhesion of oils and fats on the glass window 7 of the hinged door 8, and preventing the dispersion of the oil fumes from the chamber when the hinged door 8 is opened.

Numeral 20 designates a second circulation fan provided for making the temperature in the chamber uniform and 21, and a third circulation fan 21 is provided for making the exhaust pass through the purging device smoothly. Numeral 22 denotes an oil fume sump provided for making the density of the oil fumes generating rapidly from the foods being cooked uniform, the effect of which is described after hereinafter. Numeral 23 designates a heat insulating material such as glass wool mounted around the external wall of the cooking chamber, which is provided for preventing heat from escaping to the outside of the cooking chamber so as to increase the thermal efficiency and to make the temperature of the catalizer rise abruptly when the exhaust is passed thereover without lowering the temperature thereof.

With the above described construction, the foods to be cooked carried on the cooking shelves 5 are heated or cooked by the heaters 1 and 2 at the top and the bottom of the chamber. During this period, oil drops drip from the foods being cooked down onto the receiving plate 6. Because this receiving plate 6 is at a high temperature, oil fumes are produced. The oil adhering to the foods being cooked or on the chamber walls also produces oil fumes. Such oil fumes flow in a rising current of air from the chamber through the exhaust passage 13. The oil fumes, etc., flowing through this exhaust passage 13 are removed from the air by the action of the fume removing catalyst, so that only clean air is be discharged.

Figure 3:
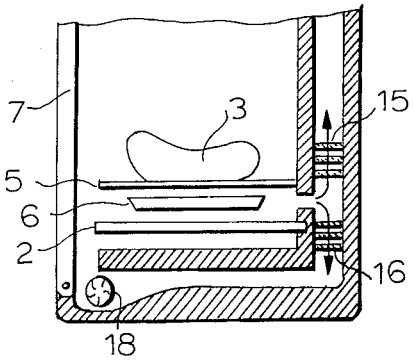
FIG. 3 is a fragmentary sectional view of a modified form of the cooking apparatus of FIG. 2.

Furthermore, in the above described embodiment, the exhaust passage inlet 12 is provided at the upper part of the cooking chamber, but when the apparatus is required to achieve good thermal efficiency, it is more effective to provide the inlet 12 at a position lower than a half the height of the cooking chamber as shown in FIG. 3. Namely, when the inlet 12 is provided in the upper portion of the chamber, a large quantity of heat is lost because the high temperature gas moves to the upper part of the chamber and exhaust to the outside of the cooking chamber. However, by providing the inlet at a position lower than half the height of the cooking chamber, the thermal efficiency will be increased because the high temperature gas stays in the cooking chamber.

Numeral 24 designates a heater which heats the exhaust. The effect caused by heating the exhaust will be now described hereinunder.

With the conventional apparatus having a catalizer for purging the oil fumes, some white fumes remain in the exhaust which has passed through the catalyzer and are not completely removed. The result of the analysis of the aforementioned fumes undertaken to find out the reason for this clearly indicated that these white fumes were not pure oil fumes, but had steam as the main component, and the result of many repetitive experiments showed that these white fumes could be almost completely removed, if the exhaust temperature at the outlet 13' through which the exhaust was discharged from the exhaust passage 13 was higher than a definite value.

Experiments conducted with the exhaust involving varying the temperature at the outlet 13 of the exhaust passage 13 in the apparatus of this invention confirmed that the fumes can be completely eliminated at temperatures above 130° C. In this experiment, the measures of the fumes were according to the gray scale, a known system for indicating the degree of blackening. The fumes considered had degrees higher than 0.75 on the gray scale, above which value fumes are generally invisible. Higher values on the gray scale indicate less visibilty.

Figure 4:
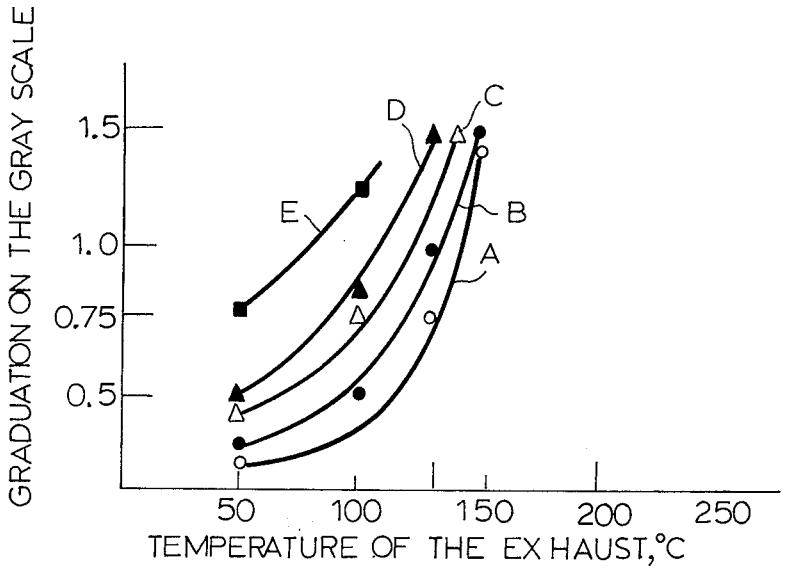
FIG. 4 is a graph showing the relations between the temperature of the exhausted gases and the graduation of the gray scale, a known system for indicating the degree of blacking.

It turned out from the result of the experiments on the white fumes described above that the discharge velocity at the outlet of the exhaust passage was also a factor. The results of the experiments at varying discharge velocities were as shown in FIG. 4. In FIG. 4, curve A is for a discharge velocity of 0.01 m/sec; curve B for 0.1 m/sec; curve C for 0.5 m/sec; curve D for 1 m/sec; and cruve E for 3 m/sec, showing that at higher discharge veloscities, the white fumes are eliminated at lower temperatures. In any cooking apparatus generally in use, discharge velocities lower than 0.01 m/sec represented by the curve A of FIG. 4 are never used. It is for this reason that positive removal of the fumes contained in the exhaust may be achieved by controlling the exhaust temperature so that it is at least above 130° C at which no white fumes are produced at a discharge velocity of 0.01 m/sec.

Furthermore, if the discharge temperature is to be maintained above 130° C, the exhaust passage can be kept warm by providing some insulation around it. This insulation is effective in light of the current temperature regulation for the operation of the cooking apparatus, and its joint use with the above described heater is feasible.

In the above example, the exhaust temperature is set with the discharge velocity of 0.01 m/sec as the standard. Conversely, by taking the inside temperature of the chamber which seldom runs lower than 100° C as the standard, a discharge velocity below which the fumes are produced in the cooking apparatuses generally in use can be determined. Then, if the discharge velocity is regulated so as to be higher than 0.5 m/sec at which 0.75 is reached on the gray scale at a time when the apparatus is held at 100° C, as indicated by FIG. 4, it is possible to completely remove the fumes contained in the exhaust.

In the following, the results of the one typical experiment conducted to confirm the effects of this invention are described.

In the experiments, the thigh of a chicken leg was baked. Hydrocarbons were produced at a concentration of about 600 ppm. This hydrocarbon concentration could be reduced to 50 ppm by providing a fume removing device in the form of a catalytic oxidation system. When the exhaust gas velocity at the outlet of the exhaust passage was 0.5 m/sec, at a 50° C exhaust gas temperature, some fumes remained as indicated by 0.4 on the gray scale for curve C in FIG. 4 but above 100° C, the fumes were completely elminated as indicated by values exceeding 0.75. Furthermore, when the exhaust temperature at the outlet of the exhaust passage was 50° C, at an exhaust velocity of 0.5 m/sec, some fumes remained, as indicated by 0.4 on the gray scale for curve C, but at 3 m. sec, the fumes where eliminated, as indicated by 0.75 on the gray scale for curve E.

Figure 5:
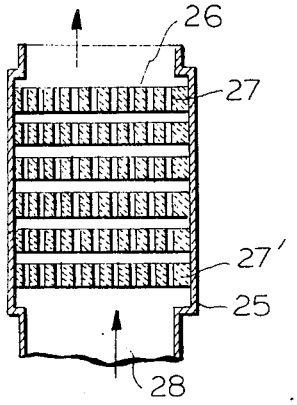
FIG. 5 is a sectional view of one form of the purging device employed in the cooking apparatus of the present invention.
Figure 6:
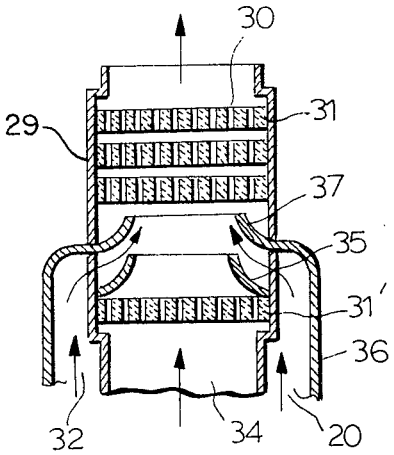
FIG. 6 is a sectional view of another embodiment of the purging device.

In the following, the catalytic device employed for this invention is described in detail: FIG. 5 shows a purging device, which is composed of oxide catalyzer layers 26 each having innumerable perforations 27 with the layers stacked in the catalyzer housing 25. The exhaust gas 28 is cleared of the fumes while passing through the catalyzer as indicated by the arrow, and is discharged out of the housing. In another embodiment of the purging device, as shown in FIG. 6, several layers 31 of oxide catalyzer having innumerable perforations 30 are stacked in the catalyzer housing 29, and a suction port for letting in the air 32 heated in the cooking apparatus is provided between the first and second layers of the catalyzer. The suction port is constructed by providing an orifice defining element 35 in the catalyzer housing 29 above the lowermost catalyzer layer 31' and a necked in portion 37 on the air intake conduit 36, so that the pressure of the heating air 32 can be effectively utilized.

The components of the oil fumes produced in the cooking apparatus have turned out to consist of oil fumes and oil drops. If the oxidizing catalyzer is used alone, the large amount of oil fumes and oil drops which are produced at the time of cooking are collected as dew on the oxidizing catalyzer. The oil and fat are first cracked, then gasified and oxidized, causing a reduced service life of the catalyzer. Accordingly, a study was pursued to develop for use as the first oil fume decomposing layer 27' or 31' of the oxidizing catalyzer for decomposing the oil fumes and oil drops, a body of expanded stainless steel, continuously porous expanded bodies formed of elemental metals including aluminum, nickel, iron, copper, zinc, etc., or alloys thereof or fibrous mats of these metals. These have been found to be effective in attaining the goal of this invention, and it is also possible to fulfill the purpose of this invention with ceramics provided with continuous pores. While the catalyzer itself may be used as the oil fume decomposing layer of this invention, two or more catalyzer layers should be provided.

The temperature of the decomposing layer for decomposing the oil fumes and oil drops should desirably be 230°–400° C. If it is lower than 230° C, the oil fumes and the oil drops are not decomposed, but are collected as dew, thereby blocking the exhaust gas flow and moreover, the thickness of the oil fume decomposing layer needs to be increased.

Although it is desirable to have a temperature higher than 400° C for the decomposition of the oil fumes, such an excessively high temperature is deleterious to the safety of the cooking apparatus and to the cooking effect. Therefore the temperature should be lower than 400° C.

The oil fume and oil drop decomposing layer should preferably have a range of thickness of 3 - 15 mm. If it is thinner than 3 mm, the effect of decomposing the oil fumes and oil drops which is the objective of this invention can hardly be obtained, and in order to achieve this effect, the decomposing layer should be held at a high temperature. A layer thicker than 15 mm would occupy an undesirably large space inside the cooking apparatus. Accordingly, the porosity of the decomposing layer needs to be such that the purpose can be served with a thickness less than 15 mm, taking into account the size of the cooking apparatus.

The porosity of the decomposing layer should preferably be on the order of 15 - 80%. The major objective of this oil fume and oil drop decomposing layer is to first decompose the oils and fats with high molecular weights into hydrocarbons and carbon compounds with low molecular weights, and subsequently to improve the efficiency of the oxidizing catalyzer. However, when the foods are cooked at a high temperature, especially at such a high temperature that they are scorched, since some amount of moisture and oil and fat is retained within the foods being cooked, the oil fumes and the oil drops are not always flowing at a constant rate, but the oil fumes come popping out through the surface of the food, which is a scorched surface, in small bursts. Accordingly, the above described objectives aside, the porous oil fume and oil drop decomposing layer is designed to equalize the amount of the oil fumes, and also to play the role of a dispersant to make the contact of the oil fumes with the catalyzer as uniform as possible as well as serving the end of preventing the catalyzer components from falling on the surface of the foods being cooked, if any components of the catalyzer should be stripped off as the result of a physical shock.

It is, of course, effective to adhesively connect the catalyzer and the oil fume and oil drop decomposing layer. Since a long lasting effect can hardly ge guaranteed by connecting these parts in this way, however, the oil fume and oil drop decomposing layer and the catalyzer should preferably be separated in the purging device.

Figure 7:
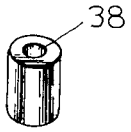
FIGS. 7 - 12 show forms of the oxide catalyzers which can be used in the purging device employed in the cooking device of the present invention.
Figure 8:
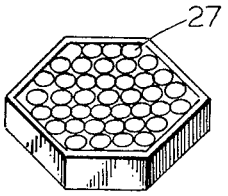
Figure 9:
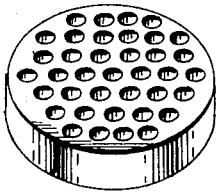
Figure 10:
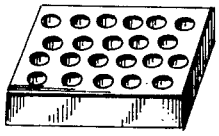
Figure 11:
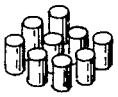
Figure 12:
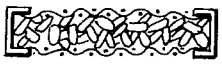

Possible forms in which the oxide catalyzer layers 26 and 31 can be used include a large number of cylinders each having a small hole 38 as shown in FIG. 7 being combined as shown in FIG. 8, or an integral layer in the shape of a cylinder having parallel holes therethrough, as shown in FIG. 9, or a rectangular plate having holes therethrough as shown in FIG. 10, or a plurality of cylindrical pellets shown in FIG. 11 being packed in a layer between two screen-like elements as shown in FIG. 12.

The oxide catalyzers usually employed are platinum catalyzers, etc., but it is effective to use manganese base catalyzers as disclosed in U.S. Pat. No. 3,905,917 for the following reasons:

(1) Their ability to remove the cooking odors and fumes and to turn harmful gases harmless is equivalent to that of platinum catalyzers.

(2) They are active over a wide range of temperatures from low to high, and withstand heat shock or any possible impacts they might get while in transit.

(3) Their prices are low, being 1/10 of that of the platinum catalyzers.

(4) They can purge $SO_2$ gas produced from the sulfur compounds contained in the foods.

A preferred form of the oxide catalyzer has manganese dioxide ($MnO_2$) as the main component, with an oxide of any of metals including Cu, Fe etc., used as an auxiliary catalyzer, and aluminic acid lime ($Al_2O_3$ CaO) as the binder.

Figure 13:
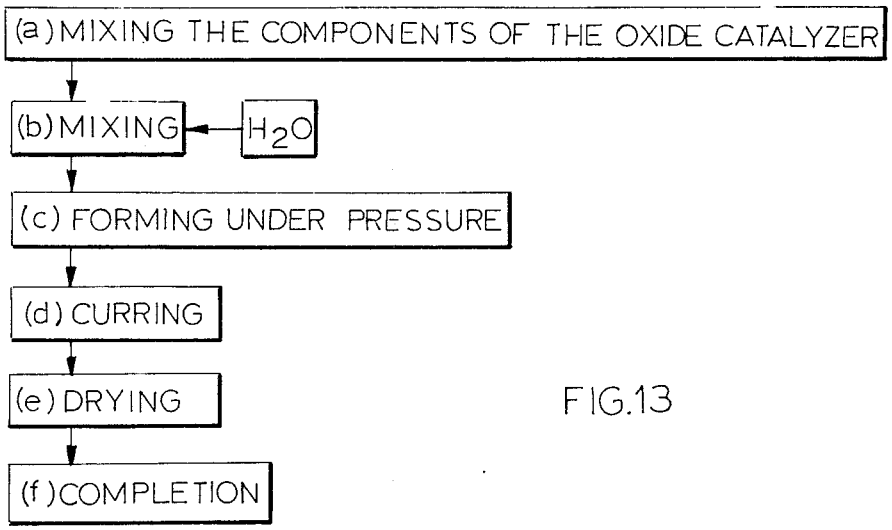
FIGS. 13 and 14 are schematic flow charts to illustrate the method of manufacturing the oxide catalyzer.

In the following, embodiments of the method of manufacturing of the oxide catalyzer are described. The first method comprises forming under pressure. The schematic flow chart of this process is shown in FIG. 13.

Taking the form of FIG. 7 for example, first, the components of the oxide catalyzer as described above are (a) mixed for 30 minutes; then, (b) mixed for 15 minutes with the addition of 5 - 10% by weight of water ($H_2O$). A powdery mixture containing moisture is produced. This mixture is charged into a mold for producing the shown in FIG. 7, and is (c) formed under pressure. In that way, the desired form is obtained, but it is still low in strength. This products is (d) cured for 1 hour in 100° C steam, and is then, (e) dried. The aluminic acid lime ($Al_2O_3$ CaO) reacts with water ($H_2O$), yielding a hard porous oxide catalyzer element. In this way, an oxide catalyzer in the form shown in FIG. 7 is (f) completed.

Figure 14:
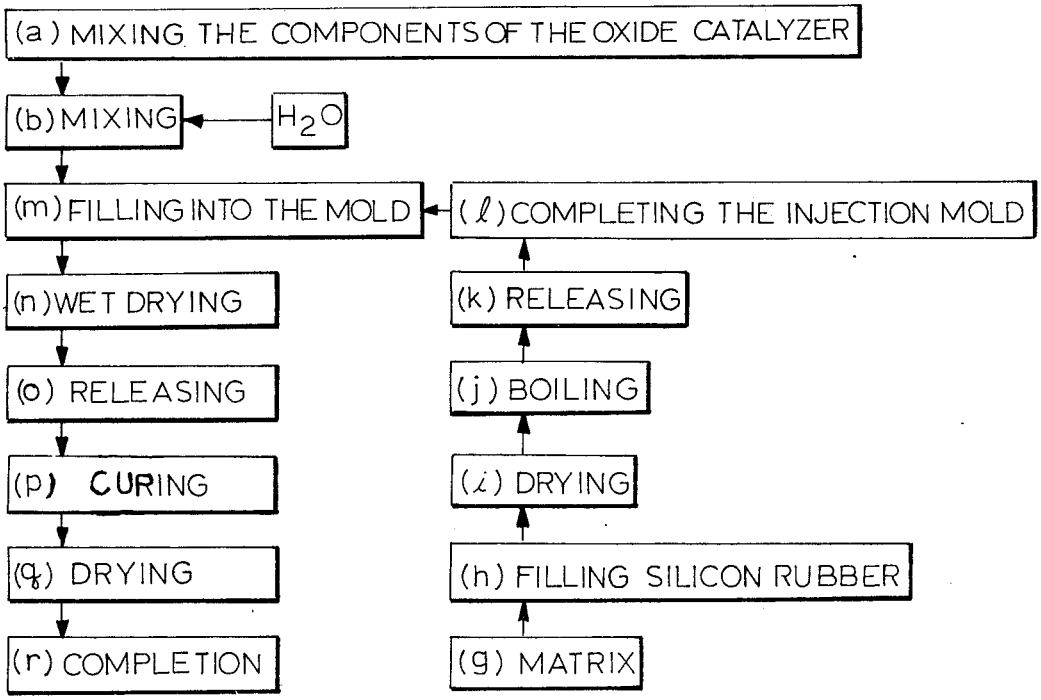
Figure 15:
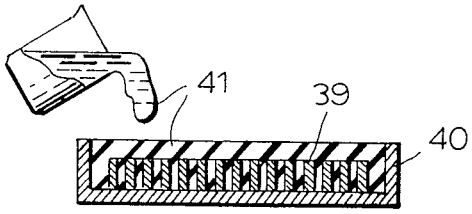
FIGS. 15 and 16 are explanatory schematic representations illustrating manufacturing steps (*g*) and (*m*) in FIG. 14, respectively.
Figure 16:
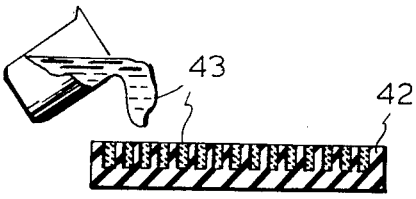

The second method comprises injection molding: The schematic flow chart is shown in FIG. 14. Taking the disc form of FIG. 9 for example, first, a metal mold in the desired form is produced, to be (g) used as the matrix. Into this matrix 39 securely set in the outside frame 40 as shown in FIG. 15, is (h) poured silicon rubber 41. Thereafter, it is (i) dried for 2 hours in air at 80° C, and the filled matrix and frame are then, (j) boiled in boiling water for 1 hour. As a result, the silicon rubber 41 hardens. After cooling, the matrix 39 and the outside frame 40 are dismantled, and the hardened silicon rubber 41 is (k) released, to be (1) completed as the injection mold for the oxide catalyzer, which is hereinafter referred to tentatively as SR mold 42. Then, the same components of the oxide catalyzer as those used in the first method are (a) mixed for 30 minutes, and (b) mixed for 15 minutes with 20 – 30% by weight of water ($H_2O$) being added to this mixture, yielding a mixture 43 in the form of slurry. Then, this slurry is (*m*) filled into the SR mold 42 as shown in FIG. 16. Thereafter, the slurry 43 is (*n*) wet dried in air at 80° C, thereby completely curing it into the oxide catalyzer. After cooling the oxide catalyzer is (o) released from the SR mold 42, is (p) further cured for 10 – 20 minutes in warm water at 80° C to increase its strength, and is then, (q) dried for 1 hour in air at 150° C. In that way, an oxide catalyzer shown in FIG. 9 is (r) completed. This method is advantageous in that it permits the desired forms to be arbitrarily produced, and with small investments required for installations.

In adopting the method for removing the fumes, odors, etc., produced from the foods being cooked, by making use of the oxide catalyzer, a notable difference in its purging capacity is achieved depending on the amount of the catalyst used, its size and how it is arranged. In the connection, this inventors have conducted a few experiments. The results are described hereunder:

EXPERIMENT 1

Specific surface area of the catalyzer:

A marketed 1.2 kW (100 V) electric oven having an inside chamber with dimensions of about 250 × 300 × 300 mm has a purging device installed in a 120 mm hole opened in its ceiling.

Mn base catalyzers having the above described composition and having specific a surface areas of 10 $m^2/g$, 50 $m^2/g$ and 100 $m^2/g$, respectively were also prepared. Using these catalyzers, the difference in the purging rate was studied. The results are depicted in FIG. 17.

Figure 17:
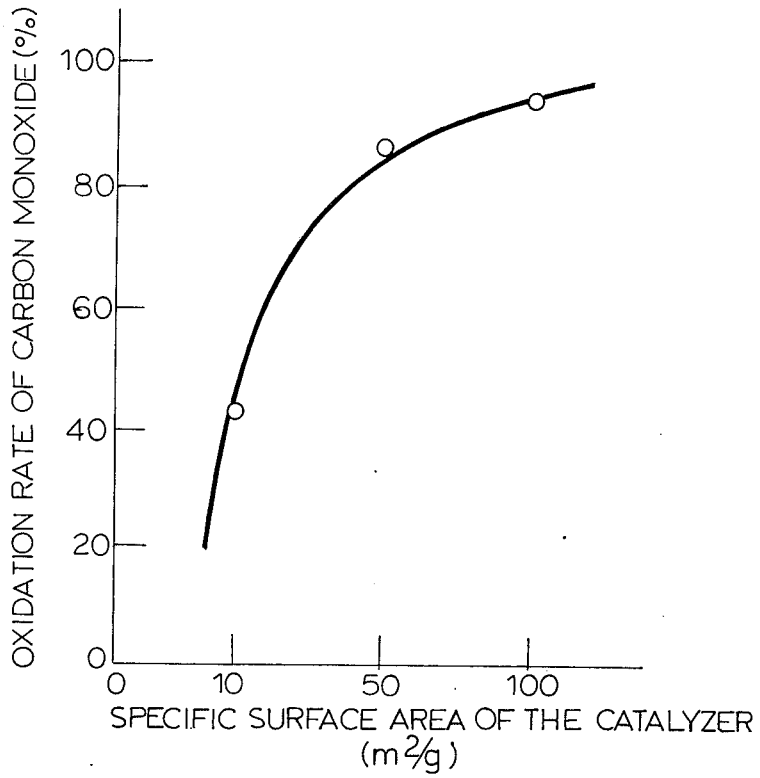
FIG. 17 is a graph showing the relation between the specific surface area of the catalyzer and the capacity for purging carbon monoxide.

FIG. 17 shows that if the specific surface area is reduced to less than 10 $m^2/g$, the catalytic action sharply declines.

On the other hand, with specific areas over 100 $m^2/g$, no notable increased effect on the purging action is obtained.

EXAMPLE 2

Amount of the catalyst:

Under the same condition as in Example 1, the capacity for purging hydrocarbons was examined as related to the amount of the catalyst, and accordingly, the purification rate at various exhaust gas velocities was measured at catalyzer temperatures of 150° C and 300° C. The exhaust gas velocity is generally used as an index for representing the relationship between the exhaust rate and the amount of catalyzer, being designated as the exhaust rate in $m^3$/hr/amount of catalyzer in $M^3$. In determining the velocity, it was difficult to change the exhaust rate, and for this reason, the amount of catalyzer alone was varied in this experiment.

Figure 18:
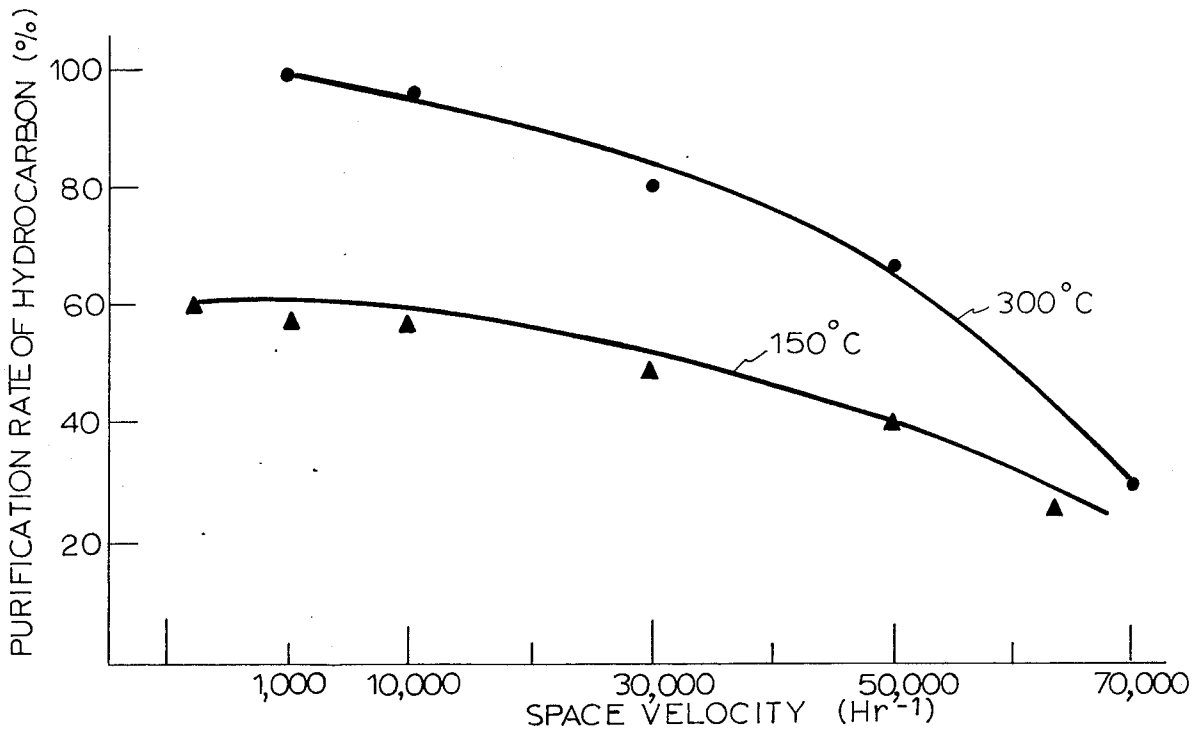
FIG. 18 is a graph showing the relation between the capacity for purging the hydrocarbons and the space velocity with varying the catalyzer temperatures.

FIG. 18 indicates that at the velocities of 1,000 – 50,000 $Hr^{-1}$, the hydrocarbon purging rate will run above 40%, an almost safisfactory result.

EXAMPLE 3

Number of catalyzers used:

In order to ascertain the effect of arranging the catalyzers in a plurality of layers, one sheet of catalyzer 120 mm in diameter and 45 mm thick, weighing about 400 g; 3 sheets, of catalyzer 15 mm thick, weighing about 400 g; and 4 sheets of 10 mm thick catalyzer, weighing about 320 g; were respectively prepared. These sheets were put in the oven of Experiment 1 in performing this experiment. Test pieces formed of a plurality of catalyzers were arranged in a plurality of layers at intervals of 2 mm, 5 mm and 10 mm, respectively. The results are depicted in FIG. 19.

Figure 19:
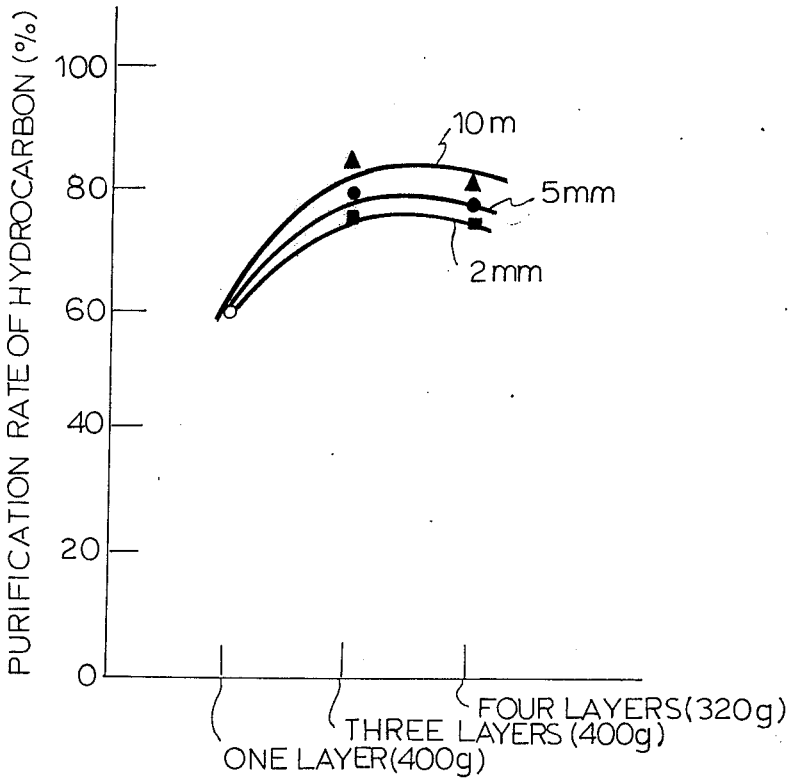
FIG. 19 is a graph showing the effect of arranging the catalyzers in multi-layers while varying the intervals of the multi-layers.

FIG. 19 shows that higher capacities for purging CO can be obtained by using the catalyzer in a plurality of layers rather than in a single layer.

Figure 20:
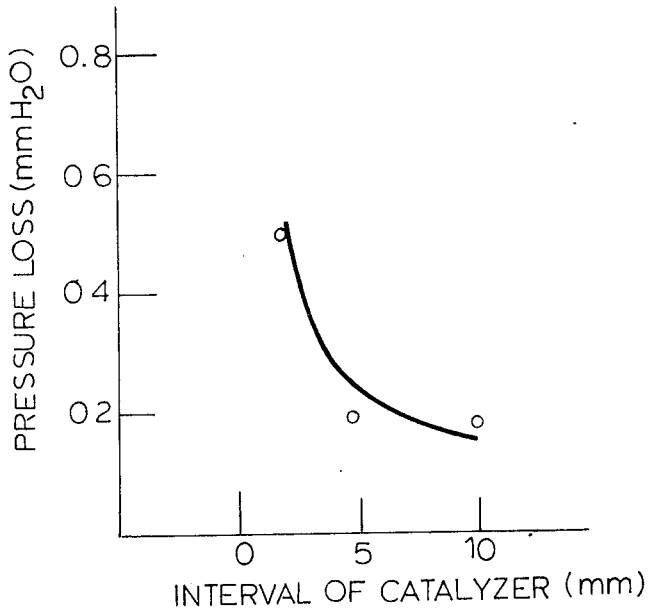
FIG. 20 is a graph showing the relation between the intervals of multi-layered catalyzers and the pressure loss.

The capacity for purging CO is not appreciably altered by changing the interval between the catalyst layers, but, as shown in FIG. 20, as the interval is reduced below 0.5 mm, the pressure loss abruptly rises. As these data suggest, it is desirable to divide the catalyzer into the largest possible number of layers, and with the interval between the layers set greater than 5 mm.

Figure 21:
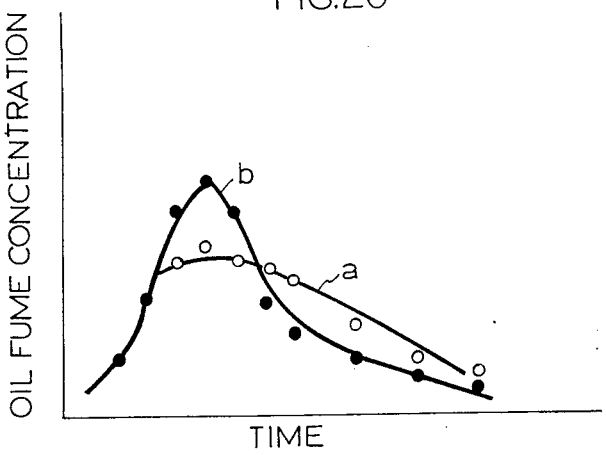
FIG. 21 is a graph showing the variation of the oil fume concentration produced from the food being cooked in relation to time.

In the foregoing, the specific surface area and the amount of the catalyst, and how the catalyzers are arranged in a plurality of layers, etc., for removing the oil fumes produced from the foods being cooked have been described. These variables aside, the amount of hydrocarbons produced from the foods being cooked has a peak value in relation to time, as shown by b in FIG. 21, and the hydrocarbon concentration is undergoing flunctuations at all times in a very short period of time, as shown by b in FIG. 22. Accordingly, a sufficient amount of catalyzer to purge the peak concentration of hydrocarbons given in FIG. 21 is required to ensure their purging.

However, if the amount of the oil fumes entering the catalyzer could be equalized during the cooking of foods, some leeway could be acquired for the purging capacity of the catalyst.

In the apparatus shown in FIG. 2, the oil fume sump 22 is provided for the purpose of equalizing the oil fumes produced, as described before.

Figure 23:
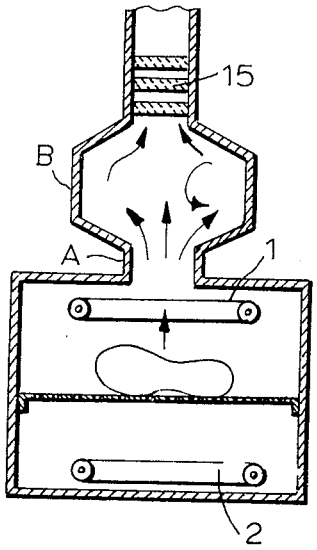
FIG. 23 is a schematic sectional view of the cooking apparatus employed in an experiment to confirm the effect of the oil fume sump.

The variations of the concentration are explained in reference to the actual experimental results as follows:

Tests were conducted with apparatuses attached to a marketed 1.2 kW(100 V) electric oven having an inside chamber with dimensions of about 250 × 300 × 300 mm. and generally shown in FIG. 23; in three of the attached apparatuses, the A part had a diameter of 120 mm $\phi$, and the B part 150 mm $\phi$, 170 mm $\phi$ and 200 mm $\phi$, respectively, and for contrast, a further apparatus, the B part had a diameter of 120 mm $\phi$. In the fume removing device, the catalyzer used (iron) had almost no catalytic capacity, and involved nearly constant pressure loss, and a hydrocarbon meter was used in measuring the hydrocarbon concentration. The experimental results are shown in Table 1.

Table 1

| B part diameter $\phi$ | Maximum H.C. concentration ppm | Minimum H.C. concentration ppm | Average H.C. concentration |
|---|---|---|---|
| 120 mm | 650 ppm | 500 ppm | 580 ppm |
| 150 | 620 | 550 | 580 |
| 170 | 600 | 570 | 585 |
| 200 | 590 | 570 | 580 |

Figure 22:
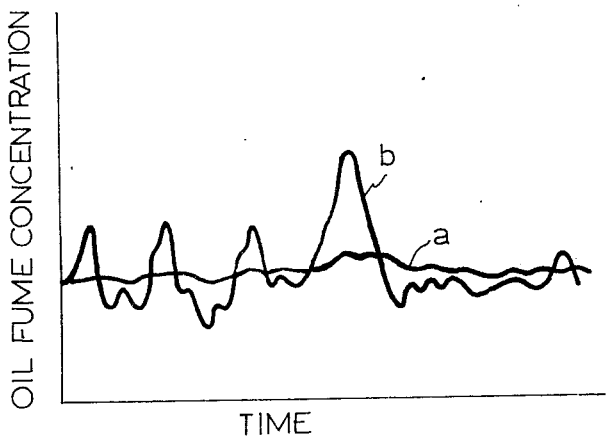
FIG. 22 is a graph showing oil fume concentration undergoing fluctuation in very short period of time.

The results, as transferred to a in FIGS. 21 and 22, clearly indicate that the peak value of the oil fume concentration shown by a for the apparatuses embodying this invention are low as compared with those for the conventional apparatus, showing favorable equalization. If such a sump is provided, the oil fumes, etc., retained in the aforementioned sump, even though locally or instantaneously at high concentrations, are equalized through dispersion and mixing, so as to have relatively low concentrations as a result. Accordingly, the fume removing device need not be constructed to have a purging capacity required for removing the oil fumes at expected high local or instantaneous concentrations. It is only necessary to make the purging capacity sufficient to handle the relatively low concentration achieved by the equalization.

Figure 24:
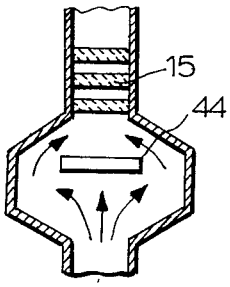
FIG. 24 a similar view of another embodiment of the oil fume sump.

Furthermore, a greater effect of dispersion and mixing of the oil fumes can be achieved by providing a diffusion plate 44 in the aforementioned sump, as shown in FIG. 24.

What we claim is:

1. A cooking apparatus having a cooking chamber for cooking a food and a purging device for receiving the exhaust gas from the cooking chamber and purging the gas, said purging device having a housing with an exhaust inlet for receiving the exhaust gas from the cooking chamber and admitting it into the housing and an exhaust outlet for exhausting the gas into the outside of the apparatus, and at least one catalyzer arranged transversely of the housing and having passages therein through which the gas is passed for purifying it, said catalyzer having a specific surface area of 10 $m^2/g$ to 100 $m^2/g$, and being composed of manganese dioxide as the main component and aluminic acid lime as a binder, and means for maintaining the temperature of the gas at the outlet of said housing higher than 130° C and wherein the inside condition of the apparatus is controlled so that the space velocity is 1,000 – 50,000 $hr^{-1}$.

2. A cooking apparatus having a cooking chamber for cooking a food and a purging device for receiving the exhaust gas from the cooking chamber and purging the gas, said purging device having a housing with an exhaust inlet for receiving the exhaust gas from the cooking chamber and admitting it into the housing and an exhaust outlet for exhausting the gas into the outside of the apparatus, and at least one catalyzer arranged transversely of the housing and having passages therein through which the gas is passed for purifying it, said catalyzer having a specific surface area of 10 $m^2/g$ to 100 $m^2/g$, and being composed of manganese dioxide as the main component and aluminic acid lime as a binder, and means for maintaining the discharge rate of the gas at the outlet of said housing higher than 0.5 m/sec. and wherein the inside condition of the apparatus is controlled so that the space velocity is 1,000 –50,000 $hr^{-1}$.

* * * * *